United States Patent [19]

Koyamato

[11] Patent Number: 4,679,479

[45] Date of Patent: Jul. 14, 1987

[54] ELECTRONIC DRUM

[75] Inventor: Hisakazu Koyamato, Hamamatsu, Japan

[73] Assignee: Nippon Gakki Seizo Kabushiki Kaisha, Hamatsu, Japan

[21] Appl. No.: 857,165

[22] Filed: Apr. 29, 1986

[30] Foreign Application Priority Data

May 1, 1985 [JP] Japan ..... 60-92352

[51] Int. Cl.[4] ..... G10H 3/14

[52] U.S. Cl. ..... 84/1.04; 84/DIG. 24

[58] Field of Search ..... 84/1.04, 1.01, 1.03, 84/DIG. 24

[56] References Cited

U.S. PATENT DOCUMENTS 4,479,412 10/1984 Klynas ..... 84/1.04

FOREIGN PATENT DOCUMENTS 55-97792 7/1980 Japan .

58-113070 8/1983 Japan .

59-39753 11/1984 Japan .

*Primary Examiner*—Arthur T. Grimley

*Assistant Examiner*—David Warren

*Attorney, Agent, or Firm*—Blakely, Sokoloff, Taylor & Zafman

[57] ABSTRACT

An electronic drum includes a relatively hard surface layer, a relatively hard base layer, a relatively hard coupling portion, and a detection element. The base layer is spaced apart from the surface layer by a predetermined distance. The coupling portion couples the surface layer to the base layer. The detection element is mounted on the base layer to detect striking of the surface layer. The surface layer and the coupling portion are nonfoamed layers. The base layer is a combination of a nonfoamed or foamed layer and a support plate. A foamed layer is inserted as an impact absorbing layer between the surface and base layers.

11 Claims, 5 Drawing Figures

ELECTRONIC DRUM

BACKGROUND OF THE INVENTION

The present invention relates to an electronic drum.

In a conventional electronic drum, a drum head is struck with sticks and vibrations are converted to electrical signals. The generation of musical tones (electronic tones) in an electronic sound source device (e.g., a PCM or FM sound source) is controlled to produce electronic tones at a loudspeaker according to waveshape information (e.g., time position and volume level) for the electrical signals. In order to achieve the above operation, the following conditions are required: (1) the output (sensitivity) of a pickup unit is uniform regardless of the struck position of the drum head; (2) a signal magnitude changes depending on the striking forces in order to satisfy the player's feel; and (3) sticking is similar to an acoustic drum. It is therefore obvious that the performance of the electronic drum is determined by the drum head material and drum head assembly. Various types of conventional drum heads have been proposed, as described in Japanese Utility Model Publication No. 59-39753 and Japanese Utility Model Prepublication Nos. 55-97792 and 58-113070.

In an electronic percussion musical instrument described in Japanese Utility Model Publication No. 59-39753, the edges of two vibration films are adhered through a cushion member and a pickup to constitute a drum head. The means for supporting under tension the drum head has a complicated structure and is difficult to handle. In addition, sensitivity varies depending on the striking position, a decisive drawback. In an electronic percussion musical instrument in Japanese Utility Model Prepublication No. 55-97792, a tray is arranged at an opening of a musical instrument body and a cushion member is accommodated therein. The cushion member is covered with a striking film. The striking film must be supported with a predetermined tension force. The structure is complicated and subject to sensitivity variations in the same manner as the instrument in Japanese Utility Model Publication No. 59-39753. In a drum trainer described in Japanese Utility Model Prepublication No. 58-113070, a rubber foamed member having a rubber hardness of 8° to 10° is formed on the surface of a base, and a pseudo head is adhered to the rubber foamed member. Although good sticking feel can be achieved, this apparatus is only a trainer and is thus unsatisfactory as a pad for an electronic drum.

Another conventional electronic drum is illustrated in FIG. 5. A tensed drum head 1 is supported on a body 2. A cushion 4 is inserted between the drum head 1 and an intermediate plate 3. A dynamic speaker as a microphone 5 is mounted on the lower surface of the intermediate plate 3. In this electronic drum, although sticking feel is similar to an acoustic drum, high-frequency characteristics are poor, and sophisticated stick work tends to be lost. In addition, the microphone 5 itself has a larger thickness, and thus the drum itself becomes thicker.

SUMMARY OF THE INVENTION

It is, therefore, a principal object of the present invention to provide an electronic drum having a pad with small sensitivity variations.

It is another object of the present invention to provide an electronic drum wherein sticking feel is similar to that of the acoustic drum.

It is still another object of the present invention to provide an electronic drum which when struck produces little noise.

It is still another object of the present invention to provide a simple electronic drum which can be easily operated.

In order to achieve the above objects of the present invention, there is provided an electronic drum comprising: a relatively hard surface layer; a relatively hard base layer formed to be spaced apart from a lower surface of the surface layer by a predetermined distance; a relatively hard coupling portion for coupling the surface layer to the base layer; and a detecting element, mounted on the hard base layer, for detecting vibrations upon striking of the surface layer.

DESCRIPTION OF THE PREFERRED EMBODIMENTS

The present invention will be described in detail with reference to the preferred embodiments.

Figure 1:
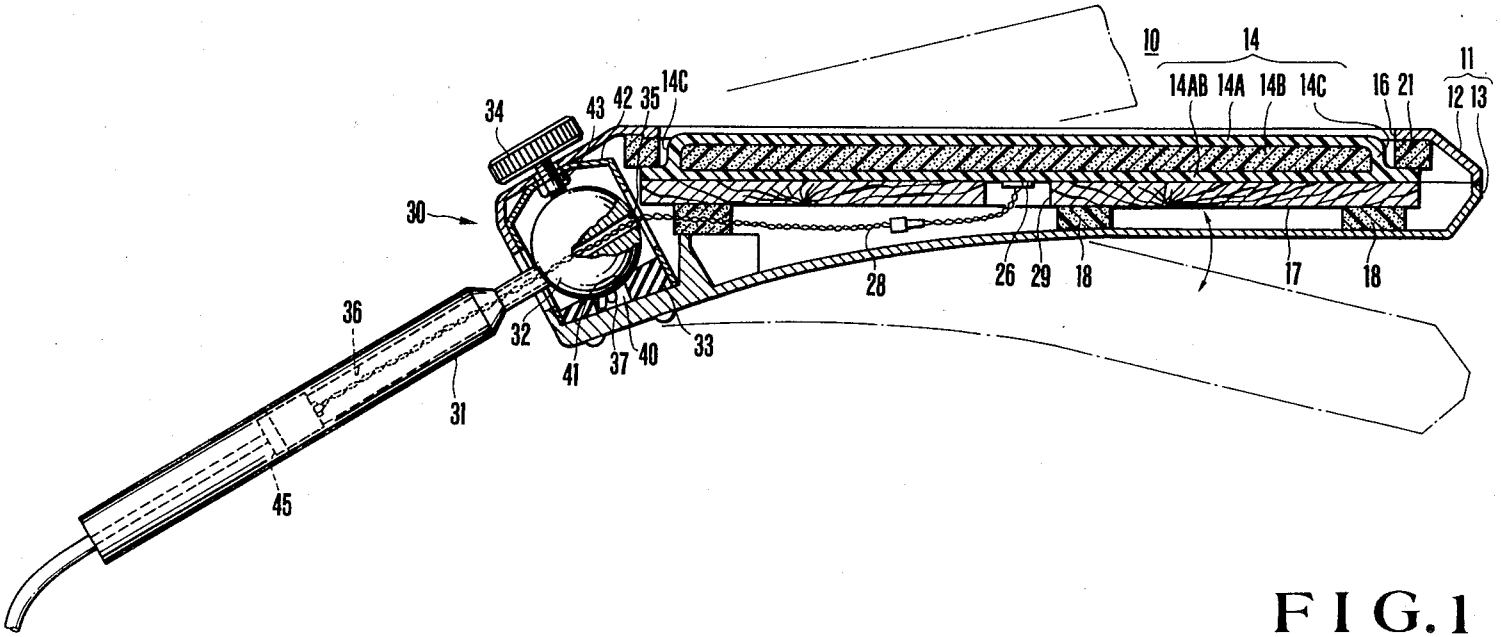
FIG. 1 is a longitudinal sectional view of an electronic drum with a pad according to an embodiment of the present invention.

FIG. 1 shows an electronic drum according to an embodiment of the present invention. Referring to FIG. 1, an electronic drum 10 includes separate upper and lower covers 12 and 13 integrally coupled by set screws (not shown). The upper and lower covers 12 and 13 constitute a musical instrument body 11. A pad 14 as the main feature of the present invention and an angle adjusting unit 30 for adjusting a setting angle of the electronic drum 10 are accommodated in the body 11.

The pad 14 consists of a relatively hard surface layer 14A serving as a striking surface, an impact absorbing layer 14B formed on the lower surface of the surface layer 14A and softer than the surface layer 14A, a lower surface layer 14Ab for supporting the layers 14A and 14B, and a coupling portion 14C for coupling the edge of the surface layer 14A to the lower surface layer 14Ab. The surface layer 14A, the lower surface layer 14B and the coupling portion 14C can be made of the same material, e.g., a film-like nonfoamed layer (also called an integral skin) obtained by controlling the foaming state of a plastic such as polyurethane. The impact absorbing layer 14B is a flexible foamed layer of polyurethane. The thickness of the nonfoamed layers 14A, 14Ab, and 14C varies depending on the size of the pad but generally falls within the range of 0.1 to 10 mm, preferably 0.1 to 5 mm. The surface and impact absorbing layers 14A and 14B are placed on a reinforcing plate 17 through a cushion member 18 formed on the inner surface of the lower cover 13 of the body 11, so that the surface layer 14A as the striking surface is fitted in an upper surface opening 16 of the upper cover 12. The reinforcing plate 17 supports the surface, lower surface, and impact absorbing layers 14A, 14Ab, and 14B and transmits vibrations (to be described later). The reinforcing plate 17 is made of a plate such as a wooden plate. In this embodiment, the nonfoamed layer 14A, the coupling portion 14C, and the lower surface layer 14Ab constituting the pad are made of a relatively hard material and are integrally formed to surround the foamed layer 14B. For this reason, the lower surface layer 14Ab of the nonfoamed layer 14A which constitutes part of the relatively hard pad 14 is placed on the reinforcing plate 17. A cushion member 21 is also inserted between the inner surface of the upper cover 12 and the peripheral surface of the pad 14, thereby firmly fixing the pad 14 and the reinforcing plate 17 inside the body 11. The cushion member 21 prevents vibrations of the body from being transmitted to the drum pad 14. A pickup device 26 including a detection element such as a piezoelectric element is fixed to the about central portion of the lower surface of the lower surface layer 14Ab to convert vibrations to electrical signals. A hole 29 is formed at a position in the about central portion of the reinforcing plate 17 corresponding to the pickup device 26. Lead wires 28 from the pickup device 26 extend downward through the hole 29.

The angle adjusting device 30 is used to fix the electronic drum 10 to a musical instrument support member 31 in a stand (not shown) at a desired angle. The angle adjusting device 30 includes a spherical member 32 mounted at the distal end of the musical instrument support member 31 and located within the body 11, a seat member 33 fixed at a position on the inner bottom surface of the lower cover 13 corresponding to the spherical member 32, and an angle adjusting screw 34 mounted on the upper cover 12 to cause the spherical member 32 to urge against the seat member 33. The spherical member 32 is made of an elastic material to absorb vibrations. A lead wire hole 35 for receiving the lead wires 28 is formed in the spherical body 32. One end of the hole 35 communicates with a central hole 36 of the support member 31. A stopper pin 37 extends at the center of the lower surface of the spherical member 32.

A recess 40 is formed in the seat member 33 to receive the stopper pin 37. Contact of the inner wall of the recess 40 with the stopper pin defines the vertical pivotal movement range of the electronic drum 10. As a result of this contact, even if the angle adjusting screw 34 is accidentally loosened, the electronic drum 10 will not abruptly pivot downward. The upper surface opening of the recess 40 is removed such that its radius of curvature is the same as that of the spherical member 32, thereby constituting a spherical member receiving surface 41.

A ball housing 42 is arranged inside the body 11 to cover the spherical member 32 and the seat member 33. A nut 43 is fixed by welding to the inner surface of the ball housing 42. An angle adjusting screw 34 is threadably engaged with the nut 43.

A female connector 45 is mounted on the support member 31 at the stand side thereof. The lead wires 28 extending through the lead wire hole 35 of the spherical member 32 are connected to the terminals of the connector 45 through the support member 31. An electronic sound source device (not shown) is connected to the connector 45 through a connection cord (not shown).

With this pad structure, when the player strikes the pad 14 with a stick, an impact acting on the surface layer 14A of the pad propagates mainly through the relatively hard portion, i.e., in the lower surface layer 14Ab through the coupling portion. The vibrations are detected by the pickup device 26. With this arrangement, since the pickup device 26 is located away from the surface layer 14A of the pad, the striking vibrations are detected by the pickup device 26 by the repeated reflection of the vibrations through the propagation path, and variations in sensitivity due to variations in striking position can be prevented. In a typical conventional electronic drum, the pickup device is simply mounted on the surface layer of the hard surface layer. Even if the surface layer is struck in two positions with an identical force, the position nearer the pickup device is detected as having a higher level, thus resulting in sensitivity variations. Such variations can be eliminated as described above. The electrical signal from the pickup device represents a striking force, and generation of musical tones (electronic tones) from the electronic sound source device can be controlled to produce electronic tones at a loudspeaker.

The foamed layer 14B serving as the impact absorbing layer fills in the space defined by the surface layer 14A and the coupling portion 14C for coupling the lower surface layer 14Ab and the edge of the surface layer 14A. Therefore, the striking vibrations are absorbed by the foamed layer 14B and are greatly attenuated, lowering the actual volume level. The vibrations detected by the pickup device 26 thus have a low amplitude. However, once the vibrations are converted to electrical signals, they can be amplified to a desired volume level. Therefore, the volume levels of the musical tones actually produced at the loudspeaker can be high. In the pad 14, the nonfoamed layer as the surface layer 14A consists of a film, and the inner layer is constituted by the foamed layer 14B to provide sufficient flexibility. The same sticking feel as in an acoustic drum can therefore be obtained. Vibrations propagate from the peripheral portion of the relatively hard nonfoamed layer 14A to the lower surface of the pad 14 and are detected by the pickup device 26 mounted on the relatively hard nonfoamed layer as the lower surface 14Ab. In addition, vibrations propagate through air sealed in the foamed layer (open-cell foam is preferred, but closed-cell foam can also be used) 14B to the nonfoamed layer 14Ab. Vibrations over the broad area can be averaged to produce uniform propagation conditions. Therefore, sensitivity variations of the pad 14 due to different striking positions thereon can be eliminated.

Since the pad 14 and the reinforcing plate 17 are floated and supported by the cushion members 18 and 21, external vibrations conducted through the stand can be absorbed, and the S/N ratio can be increased.

A method of forming the pad 14 with a nonformed layer as a surface layer 14A and a foamed layer as an inner layer will be described below. In the normal process, a nonfoamed film or sheet is adhered to the upper surface of a foamed body, or a material containing a foaming agent is injected in a space surrounded by a nonfoamed film or sheet. Another method which does not use a preformed film is described in Japanese Patent Publication No. 47-25149. A material containing a foaming agent passes through paths having different foaming conditions, and the different foamed bodies are then integrated. Still another method is described in Japanese Patent Publication No. 47-8155. Materials of different viscosities are used and a foaming agent is contained only in the material with the higher viscosity. The materials are then injection-molded. According to a recently developed method, after a foamed body is prepared, an upper mold is moved slightly upward to pour a coating liquid between the foamed body and the molds. The molds are closed and compressed to harden the coating liquid, thus forming a nonfoamed layer on the foamed body.

Depending on which of the above known methods is selected, the materials for the nonfoamed layer and the foamed layer may or may not be compatible, and the thickness range for possible nonfoamed layers may vary. Therefore, the best method must be selected in consideration of the size of the pad 14 and associated mechanical characteristics.

Figure 2:
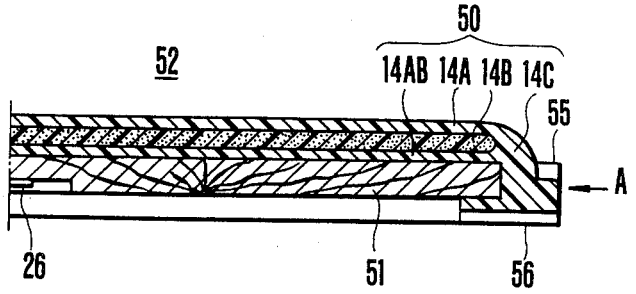
FIG. 2 is a sectional view showing a main part of a pad according to another embodiment of the present invention.
Figure 3:
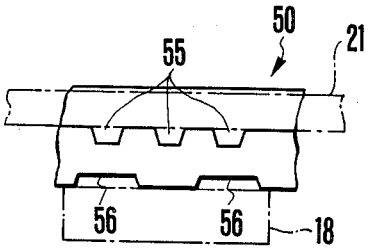
FIG. 3 is a view of the main part in FIG. 2 as seen from arrow A thereof.

FIGS. 2 and 3 show a pad according to another embodiment of the present invention. The same reference numerals in FIGS. 2 and 3 denote the same parts as in FIG. 1, and a detailed description thereof will be omitted.

Figure 4:
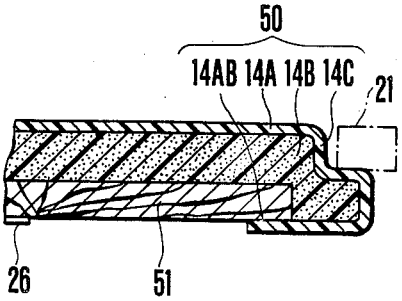
FIG. 4 is a sectional view showing a main part of a pad according to still another embodiment of the present invention.
Figure 5:
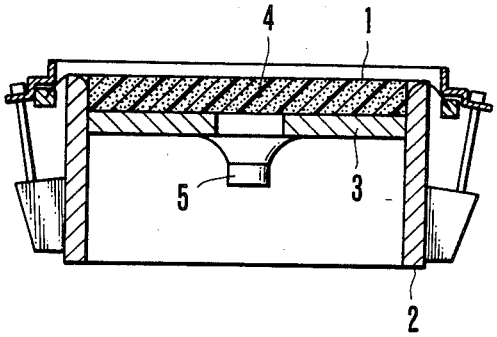
FIG.5 PRIOR ART
FIG. 5 is a sectional view of a conventional electronic drum.

A pad 52 consists of a flexible pad body 50 and a core 51. The pad body 50 consists of a relatively hard nonfoamed layer as a surface layer 14A and a relatively soft foamed layer as an impact absorbing layer 14B accommodated inside the surface layer 14A. The core 51 is formed by insert molding on the lower surface of the pad body 50 and is made of a rigid body (e.g., wood or a metal) having a melting point higher than that of the pad body 50. A pickup device 26 is arranged at the center of the lower surface of the core 51. In this case, the lower surface of the core 51 constituting the reinforcing plate is exposed from the pad body 50. However, the core 51 may be integrally molded at the lower side of the foamed layer as the impact absorbing layer 14B. The core 51 need not be integrally formed with the pad body 50. The core 51 and the pad body 50 may be formed separately, and the core 51 may be adhered to the lower surface of the pad body 50. The distribution state of the nonfoamed layer as the surface layer 14A varies according to the fabrication method. As shown in FIG. 4, the relatively hard nonfoamed layer need not cover the entire surface of the impact absorbing layer 14B. The lower surface of the impact absorbing layer 14B can be covered with the core 51. The pickup device 26 is arranged on the lower surface of the core 51 in the same manner as in FIG. 2. Recesses 55 and 56 are formed at the edge of the pad body 50 at predetermined intervals. Absorption members 21 and 18 are fitted on the surface including the recesses 55 and 56 to support the entire pad 52, thereby preventing external vibration conduction. However, the absorption members 21 and 18 need not be used.

According to the pad 52 having the structure described above, vibrations are transmitted to the core 51 through the nonfoamed layer 14A of the pad body 50 and propagate throughout the core 51, thus further improving sensitivity variations compared to the previous embodiments. By changing the thickness and hardness of the core 51 and the distance between the core 51 and the striking surface, the stickwork feel can be adjusted. The core 51 is provided in the pad 52. Therefore, the stickwork feel at different striking positions is uniform regardless of pad support conditions.

In the electronic drum pad according to an aspect of the present invention, since the pad consists of a nonfoamed surface layer and a foamed inner layer, the stick control feel is similar to that of an acoustic drum. Sensitivity variations caused by different striking positions can be decreased. According to another aspect of the present invention, the pad includes a flexible pad body, consisting of a nonfoamed surface layer and a foamed inner layer, and a core, spaced apart from the striking surface by a predetermined distance. Vibrations can be efficiently transmitted to the core, and sensitivity variations can be substantially eliminated. The stickwork feel can be easily adjusted by changing the thickness and hardness of the core and the distance between the core and the striking surface.

What is claimed is:

1. An electronic drum comprising:

a surface layer having a predetermined hardness for generating a vibration by a performer's strike thereto;

a base layer having a predetermined hardness formed to be spaced apart from said surface layer by a predetermined distance;

a coupling portion having a predetermined hardness for transmitting said vibration to said base layer so that said base layer is vibrated by said performer's strike;

an impact absorbing layer which fills the space defined by said surface layer, said coupling portion and said base layer for absorbing an impact of said performer's strike; and a detection element mounted under said base layer for detecting the transmitted vibration via said coupling portion and for generating a detection signal responsive to said transmitted vibration so that said detection signal is responsive to said performer's strike.

2. An electronic drum according to claim 1, wherein said surface layer, said coupling portion, and said base layer are formed integrally of the same material.

3. An electronic drum according to claim 1, wherein said surface layer, said coupling portion, and said base layer are nonfoamed layers.

4. An electronic drum according to claim 2, wherein said impact absorbing layer is a foamed layer.

5. An electronic drum according to claim 1, wherein said base layer includes a wooden support plate.

6. An electronic drum according to claim 5, wherein said detection element is mounted on said wooden support plate.

7. An electronic drum according to claim 1, wherein said surface layer and said coupling portion are made of the same material, and said base layer is made of a material different from that of said surface layer and said coupling portion.

8. An electronic drum according to claim 7, wherein said base layer is made of wood.

9. An electronic drum according to claim 1, wherein said base layer comprises a wooden support plate and an intermediate layer of the same material as that of said surface layer, said intermediate layer being placed on said wooden plate and being coupled to said coupling portion.

10. An electronic drum according to claim 1, wherein a pad constituted by said surface layer, said coupling portion and said base layer is supported by a musical instrument body through a cushion member.

11. An electronic drum according to claim 1, wherein said base layer, said coupling portion, and said surface layer define a closed space.

* * * * *